US007861634B2

(12) United States Patent
Saindon

(10) Patent No.: US 7,861,634 B2
(45) Date of Patent: Jan. 4, 2011

(54) TOROIDAL CLOTH

(76) Inventor: Gilles Saindon, 25 Green Meadow Crescent, Richmond Hill (CA) L4E 3W7

( * ) Notice: Subject to any disclaimer, the term of this patent is extended or adjusted under 35 U.S.C. 154(b) by 262 days.

(21) Appl. No.: 12/010,782

(22) Filed: Jan. 30, 2008

(65) Prior Publication Data

US 2009/0188381 A1 Jul. 30, 2009

(51) Int. Cl.
*D04G 1/00* (2006.01)

(52) U.S. Cl. ..... 87/12; 289/1.5

(58) Field of Classification Search ..... 87/12, 87/53; 289/1.2, 1.5

See application file for complete search history.

(56) References Cited

U.S. PATENT DOCUMENTS 1,424,458 A * 8/1922 Fleisher ..... 28/140
1,994,659 A * 3/1935 Mascarenhas ..... 289/1.2
3,476,423 A * 11/1969 Kentfield ..... 289/17
3,606,815 A * 9/1971 Yamashita et al. ..... 87/12

OTHER PUBLICATIONS http://www.instructables.com/id/How-to-Make-a-Rubber-Band-Ball/step3/Making-a-Rubber-Band-chain/.*

Clifford W. Ashley, The Ashley Book of Knots, Doubleday, 1993, p. 269.*

* cited by examiner

*Primary Examiner*—Shaun R Hurley
(74) *Attorney, Agent, or Firm*—Gowling Lafleur Henderson LLP

(57) ABSTRACT

The present invention provides a toroidal structure comprising a plurality of closed-loop toroids interconnected together, each toroid having a body defining an interior, the toroidal structure comprising: a first toroid of the plurality of toroids having a first proximal portion and a first distal portion; a second toroid of the plurality of toroids having a second proximal portion and a second distal portion; and an interconnection between the first and the second toroid formed by looping the first proximal portion around the body of the second toroid and passing through the interior of the first toroid adjacent to the first distal portion to cause the first distal portion to be positioned adjacent to the second proximal portion.

11 Claims, 15 Drawing Sheets

| STRAIGHT PANEL | | | |
|---|---|---|---|
| FIGURE | # OF TOROIDS TO USE | | # OF TOROIDS TO SECURE |
| A | 1 | - | 1 |
| B | 1 | - | 1 |
| C | 1 | - | 1 |
| D | 1 | - | 1 |
| E | 1 | - | 2 |
| F | 1 | - | 2 |
| G | 1 | - | 2 |
| H | 1 | - | 1 |
| I | 1 | - | 2 |
| J | 1 | - | 2 |
| K | 1 | - | 2 |
| L | 1 | - | 1 |
| M | 1 | - | 2 |
| N | 1 | - | 2 |
| O | 1 | - | 2 |
| P | 1 | - | 1 |

| TRIANGULAR PANEL (EXPAND STRAIGHT PANEL) | | | |
|---|---|---|---|
| FIGURE | # OF TOROIDS TO USE | | # OF TOROIDS TO SECURE |
| A | 1 | - | 2 |
| B | 2 | - | 1 |
| C | 1 | - | 2 |
| D | 2 | - | 1 |
| E | 1 | - | 2 |
| F | 1 | - | 2 |
| G | 2 | - | 1 |
| H | 1 | - | 2 |
| I | 1 | - | 2 |
| J | 2 | - | 1 |
| K | 1 | - | 2 |
| L | 1 | - | 1 |
| M | 1 | - | 2 |
| N | 1 | - | 2 |
| O | 1 | - | 2 |
| P | 2 | - | 1 |

| CIRCULAR | | | |
|---|---|---|---|
| FIGURE | # OF TOROIDS TO USE | | # OF TOROIDS TO SECURE |
| A | 1 | - | 1 |
| B | 1 | - | 1 |
| C | 1 | - | 1 |
| D | 1 | - | 1 |
| E | 1 | - | 1 |
| F | 1 | - | 1 |
| G | 1 | - | 2 |
| H | 1 | - | 1 |
| I | 1 | - | 2 |
| J | 1 | - | 2 |
| K | 1 | - | 2 |
| L | 1 | - | 2 |
| M | 1 | - | 2 |
| N | 1 | - | 2 |
| O | 1 | - | 2 |
| P | 1 | - | 2 |

TOROIDAL CLOTH

FIELD OF THE INVENTION

This invention is related to a method and process for making a cloth and specifically a cloth having toroidal segments connected together by tying.

BACKGROUND OF THE INVENTION

Generally, cloth are made from elongated fibres such as string, yarn, rope, twine, wire or other similar open-ended structures. The fibres are bound together in a process of knitting, weaving or knotting. In addition to these there is also a non-woven process of using fibres by using glue, heat and pressure to bind or otherwise stick them together.

Currently, different cloth materials are constructed according to the needs of their application. For example, cloth and other layer materials can be used as a barrier or as a separation layer in clothing for fire and insect protection and also used for comfort and/or breathability in sporting events. Problems that exist with the cloth/layer materials used in these types of applications are that the materials can be rigid and therefore uncomfortable to use; the material is heavy due to the hardware needed to assemble the material and it is time consuming to assemble and construct the material and additional parts or tools may be needed. The material also have an uneven distribution of pressure thereby lowering its resistance to damage. Further it is generally difficult to construct materials that are both thick and breathable.

An additional problem with many existing cloth and their assembly techniques is that once they are torn this tear or run can spread throughout the material, making the cloth less effective or useless.

There is therefore a need for a cloth material having a structure and method of assembly that obviates or mitigates at least some of the above presented disadvantages.

SUMMARY OF THE INVENTION

According to one aspect of the present invention, there is provided a toroidal structure comprising a plurality of closed-loop toroids interconnected together, each toroid having a body defining an interior, the toroidal structure comprising: a first toroid of the plurality of toroids having a first proximal portion and a first distal portion; a second toroid of the plurality of toroids having a second proximal portion and a second distal portion; and an interconnection between the first and the second toroid formed by looping the first proximal portion around the body of the second toroid and passing through the interior of the first toroid adjacent to the first distal portion to cause the first distal portion to be positioned adjacent to the second proximal portion.

In another of its aspects, there is provided a method of forming a toroidal structure comprising a plurality of closed-loop toroids interconnected together, each toroid having a body defining an interior, the method comprising: providing a first toroid of the plurality of toroids having a first proximal portion and a first distal portion; providing a second toroid of the plurality of toroids having a second proximal portion and a second distal portion; and forming an interconnection between the first and the second toroid by looping the first proximal portion around the body of the second toroid and passing through the interior of the first toroid adjacent to the first distal portion to cause the first distal portion to be positioned adjacent to the second proximal portion.

In another aspect, each toroid includes an intermediate portion defined between the proximal and the distal portion and forming the interconnection comprises looping the first proximal portion around the intermediate portion of the second toroid to cause the first distal portion to be positioned adjacent to the second toroid's intermediate portion.

In another aspect, forming the interconnection comprises looping the first proximal portion around the second proximal portion and passing the first proximal portion through the interior of the first toroid.

In another aspect, the method further comprises forming a second interconnection by passing the first proximal portion through an interior of the second toroid defined by the second proximal portion and the intermediate portion to cause the first distal portion to be positioned adjacent to the second proximal portion.

BRIEF DESCRIPTION OF THE DRAWINGS

Exemplary embodiments of the invention will now be described in conjunction with the following drawings, in which.

DETAILED DESCRIPTION OF THE PREFERRED EMBODIMENT(S)

Figure 1A:
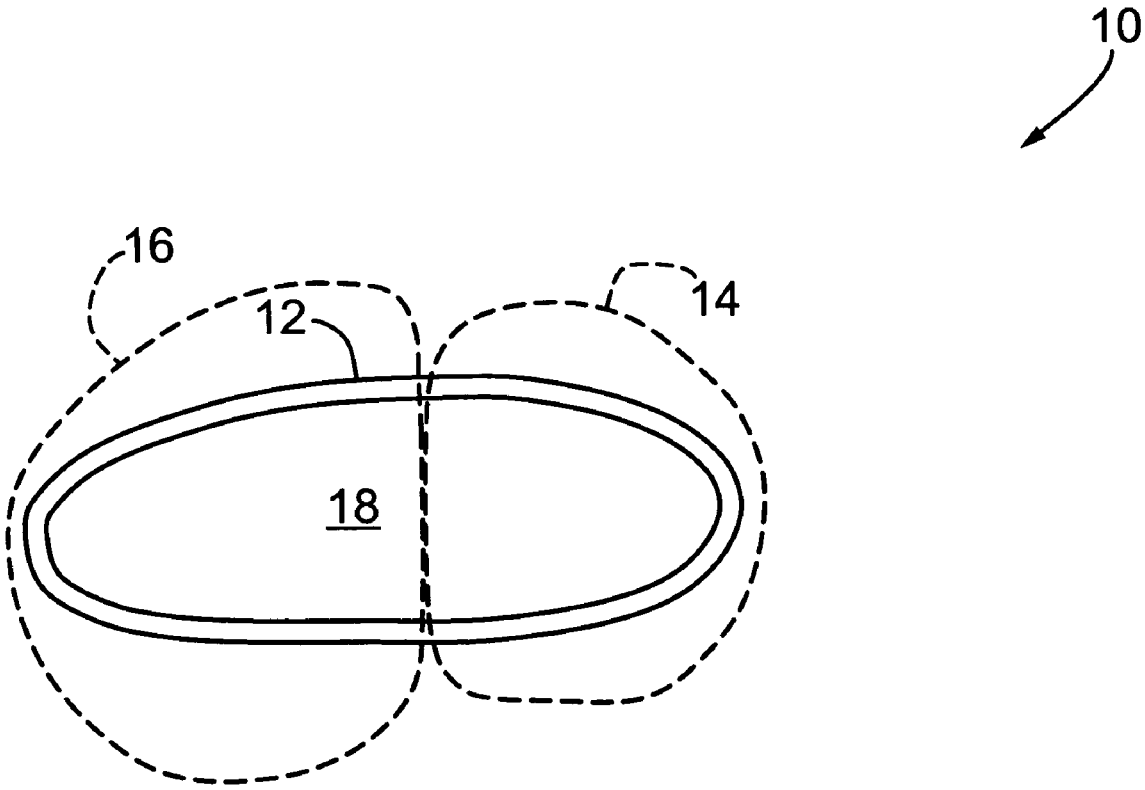
FIG. 1A illustrates a top view of a toroid and its portions.

For convenience, like reference numerals in the description refer to like structures in the drawings. As will be described herein, toroidal cloth is made by combining or tying a number of toroidal segments, or toroids. Examples of combining or tying two or more toroids together by knotting or interlocking adjacent toroids to each other can be seen in FIGS. 1-11. As will be described below, according to one embodiment two toroids are interconnected by tying them together with a standard toroidal knot (FIGS. 1-3) or a non-slip knot (FIGS.

4-6). Alternatively, the two toroids are interconnected by tying them together using other types of knots as will be understood by a person skilled in the art. According to an alternative embodiment, one or more toroids are tied to one or more other toroids using the standard toroidal knot, the non-slip knot, other knots envisaged. Once two or more toroids are tied together (e.g. using the standard toroidal knot or the non-slip knot described below), other types of attachment means can be used in addition to the knot, such as welding, snaps, clips or glue, depending on the material to secure or otherwise reinforce the formed knot further.

Toroids

As will be understood by a person skilled in the art, an object such as a segment of material that is circular or doughnut shaped is referred to as toroidal. A toroid refers to a segment of material in such a closed-loop shape. The toroidal components used herein can further be described as closed loops of any material that is preferably malleable or pliable enough to be knotted together. Alternatively, according to one embodiment, as will be discussed below, one or more non-pliable toroids are used within a sequence of cloth provided that the toroids adjacent to the non-pliable toroids are pliable.

The surface of a toroid is referred to as a torus. In mathematics, the annular shape of the toroid is generated by revolving a circle around an axis external to the circle. Examples of tori (plural form of torus) include the surfaces of doughnut shaped objects, rings and inner tubes.

A toroidal or torus object having a hole in its center can be turned inside out to yield an identical torus. Toroids as used herein can refer generally to toroids having a single hole or a torus.

For the embodiments described herein, the materials out of which toroids for the toroidal cloth are made are preferably pliable or flexible enough to tie into the described knots. However, non-pliable materials can be used in toroidal shape to create a toroidal cloth by way of using pliable toroids adjacent to non-pliable toroids. For example, within a cloth sequence envisaged herein, a non-pliable, rigid toroid composed of metal may be adjacent to one or more pliable and flexible toroids composed of textile. In this case, each pliable toroid may be tied to or otherwise attached (e.g. using clips, glue or welding) to the non-pliable toroid adjacent therewith. As will be understood, each pliable toroid may be tied or connected to the non-pliable toroid adjacent therewith using for example, one or more of the knotting techniques described herein (e.g. the standard toroidal knot).

Figure 2A:
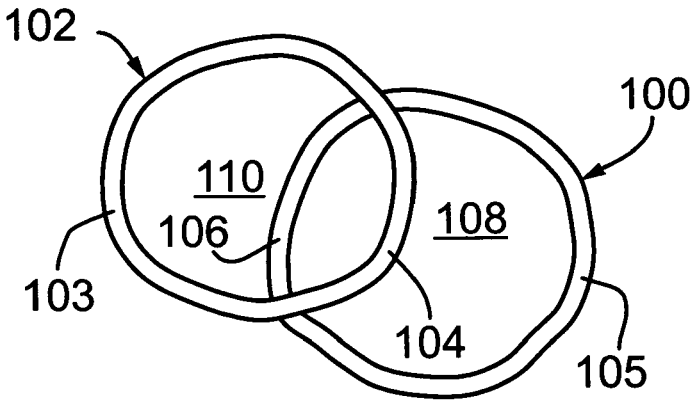
FIGS. 2A-2C illustrate a side view of two toroids during the process of making a standard toroidal knot according to an embodiment.

Referring to FIG. 1A, shown is the surface of a toroid 10. The toroid 10 comprises an annular-shaped body 16 having two arcuate portions including a proximal portion 16 and a distal portion 14 which merge to define an aperture therebetween referred to as the center or interior of the toroid 10.

Figure 1B:
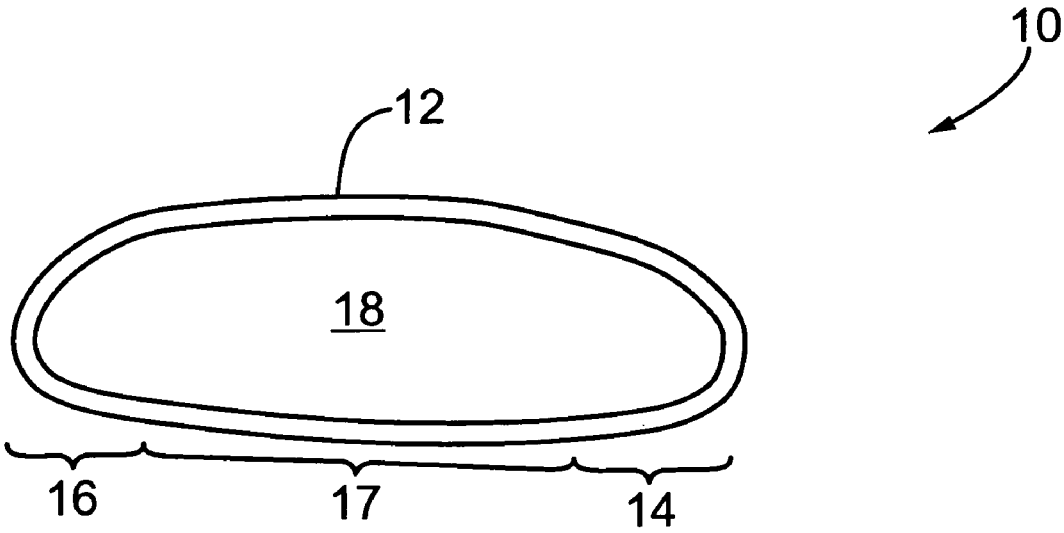
FIG. 1B illustrates a top view of a toroid and its portions according to an alternative embodiment.

Alternatively referring to FIG. 1B, a toroid 10 is defined as an annular-shaped body 12 having a proximal portion 16, a distal portion 14 and an intermediate portion 17 connecting the proximal portion 16 and the distal portion 14 together. The proximal portion 16, the intermediate portion 17 and the distal portion 14 define an aperture or interior 18 therebetween.

The term fabric referred to herein, refers for example, to a planar, circular, contoured planar, spherical, and/or three dimensional cloth textile structure produced by interlacing yarns, fibres or filaments. The term cloth used herein (e.g. material layer or other structure), refers to all textile fabrics and felts which may for example, be formed by any textile or other material, woven, knit, felted, needled, sewn, or otherwise formed.

The following provides a description of two types of knots, a standard toroidal knot and a non-slip knot used alone or in combination for tying one or more toroids to one or more other toroids. As will be understood by a person skilled in the art, other types of knots may be used to tie one or more toroids with one or more other toroids.

Standard Toroidal Knot

Figure 3A:
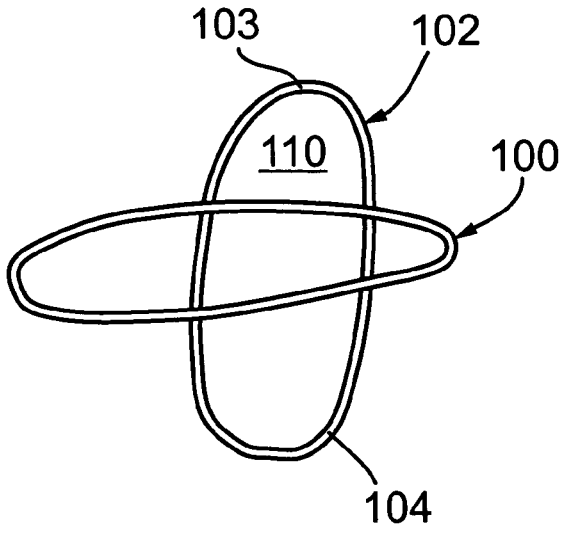
FIGS. 3A-3C illustrate a side view of two toroids during the process of making a non-slip knot according to another embodiment.
Figure 3B:
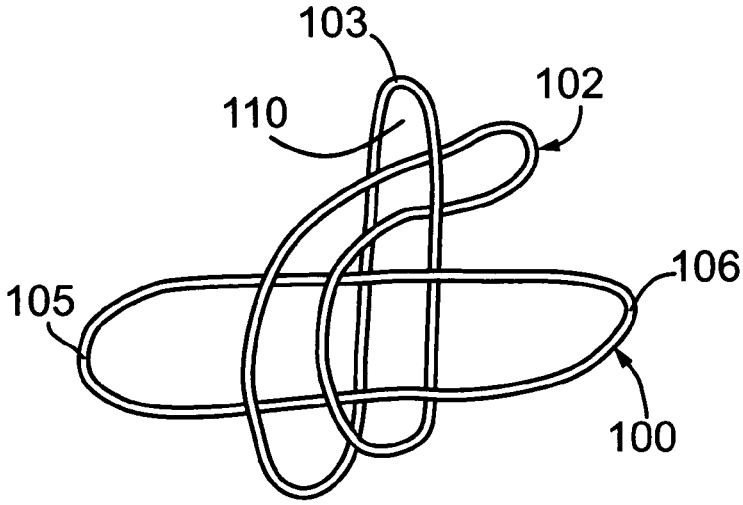
Figure 3C:
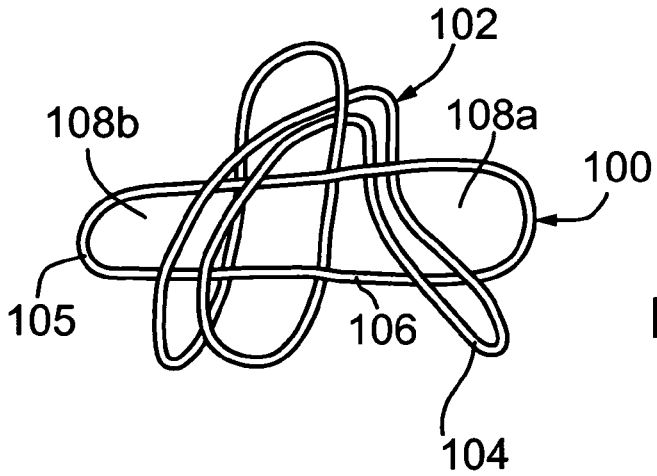
Figure 4:
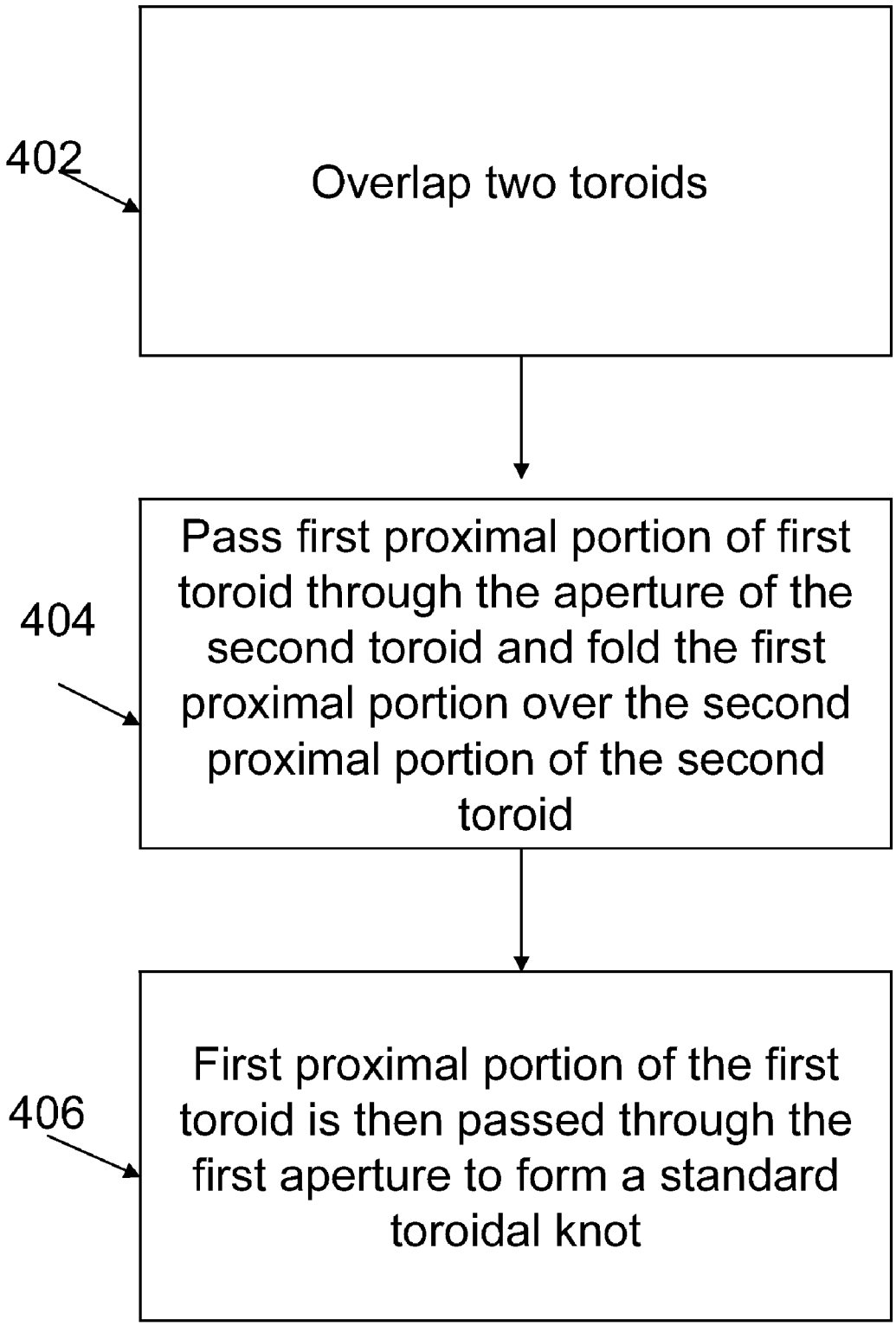
FIG. 4 is a block diagram illustrating the process for creating a standard toroidal knot.

FIG. 4 shows the process for creating a standard toroidal knot. The process is illustrated by means of a first toroid 100 and a second toroid 102 in FIGS. 2A-2C. Referring to FIG. 2A-3C, the first toroid 100 comprises a first arcuate proximal portion 106, and a first arcuate distal portion 105 defining a first aperture or interior therebetween. Similarly, the second toroid 102 comprises a second arcuate proximal portion 104 and a second arcuate distal portion 103 defining a second aperture or interior 110 therebetween.

Figure 2B:
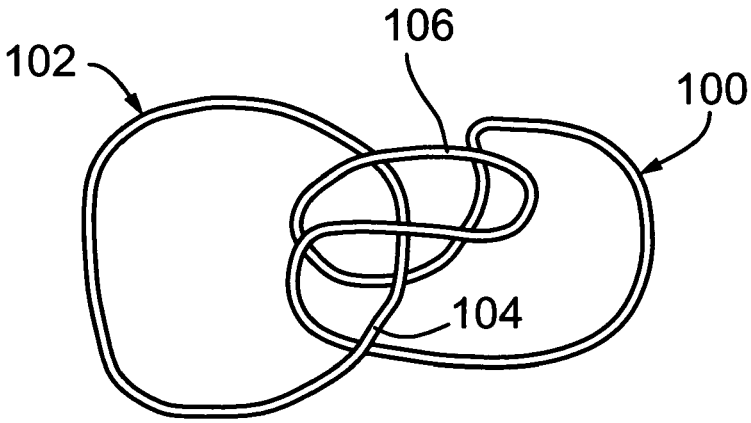

Referring to FIGS. 2 and 4, at step 402, two toroids 100, 102 are partially overlapped with the second proximal portion 104 overlapping the first proximal portion 106. At step 404 shown in FIG. 2B, the first proximal portion 106 is folded over the body 12 of the second toroid 102. In the case illustrated, the first proximal portion 106 is folded over the second proximal portion 104 by passing through second aperture 110. As will be seen, the location where the first proximal portion 106 is passed through the second aperture 110 defines where the intersection of the two toroids 100, 102 will settle. As shown in FIG. 2B, the first proximal portion 106 is folded over the second proximal portion 104 to form, for example, an elbow shape which hooks around the second proximal portion 104.

Figure 2C:
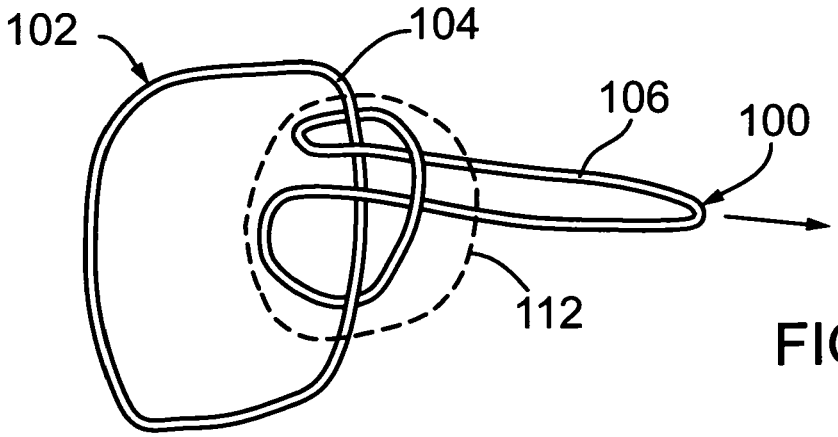

Referring to step 406 shown in FIG. 2C, the first proximal portion 106 is then passed through the first aperture 108 to form a standard toroidal knot 112. Preferably, the body of the second toroid 102 is gripped while the first proximal portion 106 is pulled tightly to secure the knot 112 formed.

Non-Slip Knot

Figure 5:
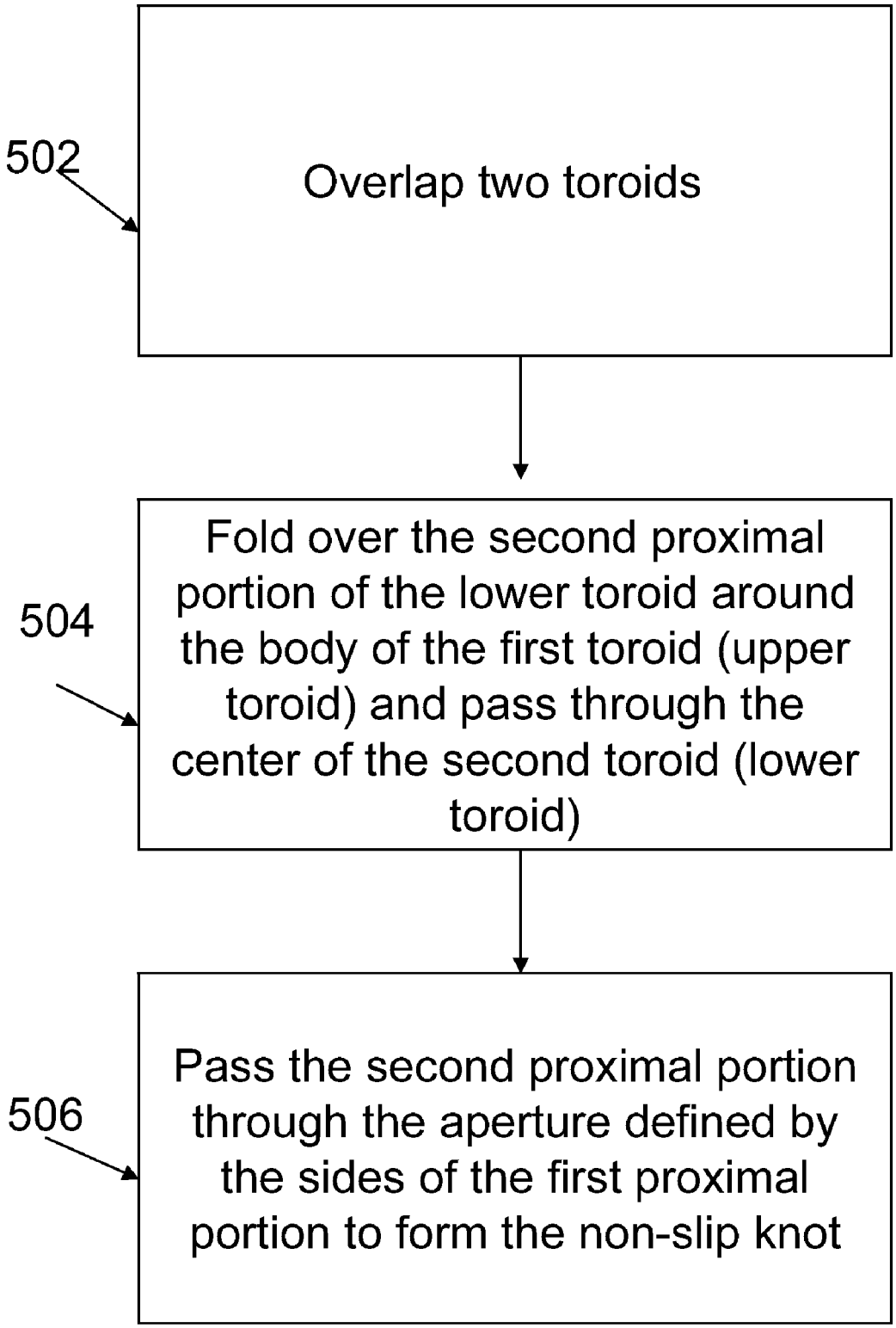
FIG. 5 is a block diagram illustrating the process for creating a non-slip knot.

FIG. 5 shows the process for creating a non-slip knot between two toroids 100 and 102 as illustrated in FIGS. 3A-3C. At step 502, the second toroid 102 (shown as the lower toroid) is overlapped by the first toroid 100. The first toroid 100 is placed transversely to the second toroid 102 such that that the second proximal portion 104 and the second distal portion 103 extend away from the body of the first toroid 100. As illustrated in FIG. 3C, the location of the non-slip knot created by the second toroid 102 along the body of the first toroid 100 is defined by the transverse location of the second toroid 102 relative to the body of the first toroid 100. That is, according to one embodiment, the user can decide where the non-slip knot will be made along the first toroid 100 by pinching the two sides of the first toroid 100 at this point to cause the center of the toroid 100 to collapse. This aligns the two sides of the first toroid 100 to be next to each other thereby creating a unified trunk/body.

At step 504, illustrated in FIG. 3B, the second proximal portion 104 is folded around the body of the first toroid 100 (e.g. around the intermediate portion 17) transversely to the longitudinal axis defined by the body of the first toroid 100. The second proximal portion 104 is then passed through or pulled through the center of the second toroid 110 preferably while maintaining the two sides of the first toroid 100 in a collapsed pinched position. That is, as shown in FIG. 3B, the second proximal portion 104 is passed through the second aperture 110 at a location adjacent to the second distal portion 103.

Preferably prior to tightening the knot illustrated in FIG. 3B, the non-slip knot is secured as shown in FIG. 3C and step 506. Referring to step 506, in order to secure the knot made between the two toroids 100, 102, the second proximal portion 104 is passed through the aperture 108*a* defined by the sides of the first proximal portion 106. The second proximal portion 104 and the first distal portion 105 are pulled in opposite directions to form a secure knot adjacent to the end of the first proximal portion 106. This secure non-slip knot is advantageous as it inhibits the toroids attached in this manner to move or slide relative to one another.

Lock-Knot

Figure 18:
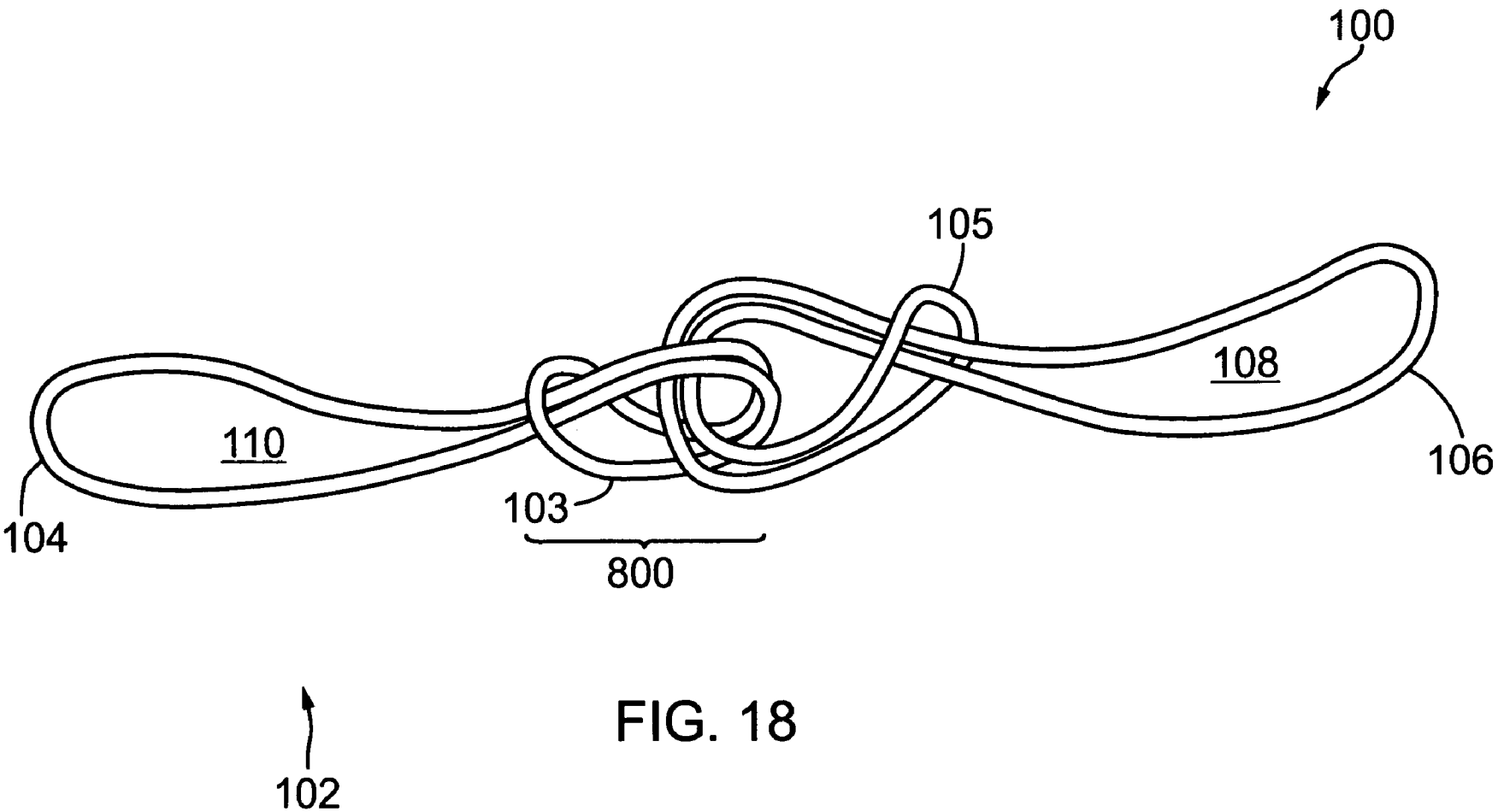
FIG. 18 illustrates a top view of the lock knot according to one embodiment.

Referring to FIG. 18, shown are two toroids 100, and 102. The first steps in forming the lock knot are similar to those described earlier relating to the non-slip knot shown in FIG. 3B. First, the second toroid 102 is placed transversely to the first toroid 100 such that the first toroid overlays the second toroid as shown in FIG. 3B. Subsequently, the second proximal portion 104 is folded around the body of the first toroid 100 (e.g. the intermediate portion 17) and passed through the center of the second toroid 110 to cause the second distal portion 103 to be positioned adjacent to the body of the first toroid 100 (e.g. the intermediate portion 17). Next, one of the first proximal portion 106 or the first distal portion 105 is passed through the center defined by the other one of the first proximal portion 106 or the first distal portion 105 (e.g. 108*a*, 108*b*). For example, the first proximal portion 106 is passed through center 108*b* adjacent to the first distal portion 105 to cause the first distal portion 105 to be placed adjacent to the first knot of the second toroid (e.g. knot 800). That is, as shown the first distal portion 105 is placed adjacent to the second distal portion 103. In this case, the lock knot is formed by manipulating both the proximal 106 and distal portions 105 of the first toroid to create the knot illustrated in FIG. 18. As described earlier the non-slip knot process is formed by manipulating one of the proximal and distal portions 105-106 to form the non-slip knot.

Toroidal Cloth

Using the standard toroidal knot or the non-slip knot, or other knots as may be envisaged for tying two adjacent toroids together, or a combination thereof, multiple toroids can be attached to form a toroidal cloth. In the embodiment of the toroidal cloths described below each toroid or more than one toroid is connected for example, via a non-slip knot or standard toroidal knot(s) to one or more other toroids. As will be illustrated (e.g. in FIGS. 6A and 6B), the toroidal cloth described herein, is advantageous as it creates thickness via the toroids while leaving open voids or apertures as a result of the toroidal components used which can be useful for breathability such as air, gas or fluids to pass through and along depending on the application used for the cloth. Accordingly, the cloth consolidates toroids into a desired form to create planar, circular, contoured planar, spherical, and/or 3-dimensional cloth.

The result is a material made of for example, numerous triangulated structures. These triangulated structures can lead to a toroidal cloth having superior strength and stress efficiency compared to existing cloths.

The triangulated structures also lead to the benefit of containing breaches in the cloth. If there is a tear, the running or spreading of the tear is contained or arrested at the adjacent toroids to the triangulated structure that was initially breached. In this case, the tear only runs on to the directly adjacent toroids. Thus, the triangulated structures also lead to the benefit of containing breaches in the cloth. If there is a cut to the cloth the spread of the damage is contained by the arms of the adjacent triangulated structures of the damaged ones. In this case, any further damage due to stress or tension is arrested by the adjacent toroids.

The properties of the toroidal cloth can be affected by the material used to make up the toroidal cloth, the number and the size of the different triangulated structures, thereby allowing a user to pre-determine the weight and flexibility of the toroidal cloth.

Figure 15:
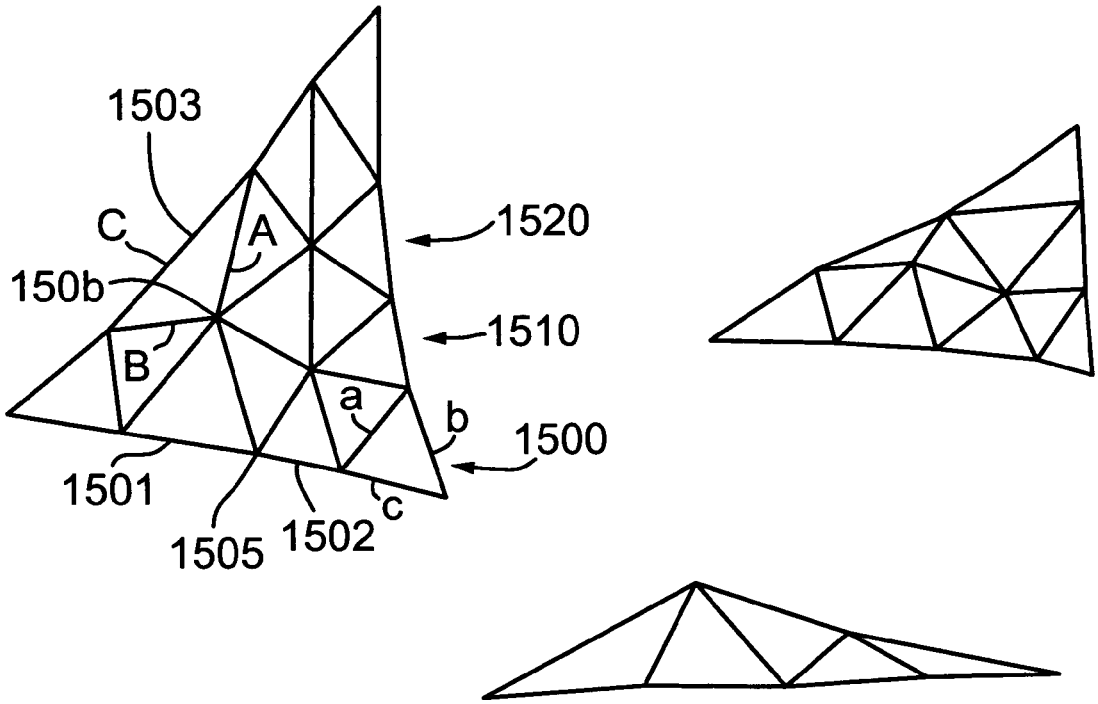
FIG. 15 illustrates a schematic diagram of assembling toroidal segments in contour form.
Figure 15:
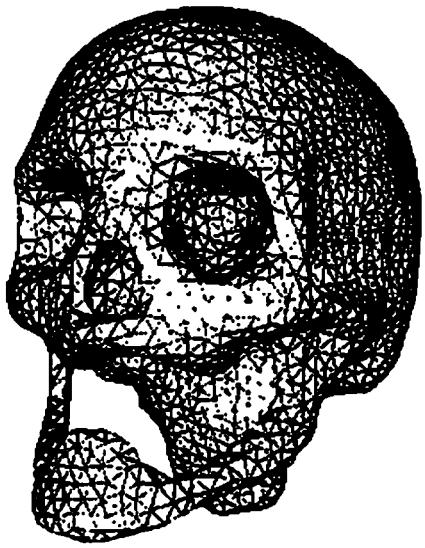
Figure 16:
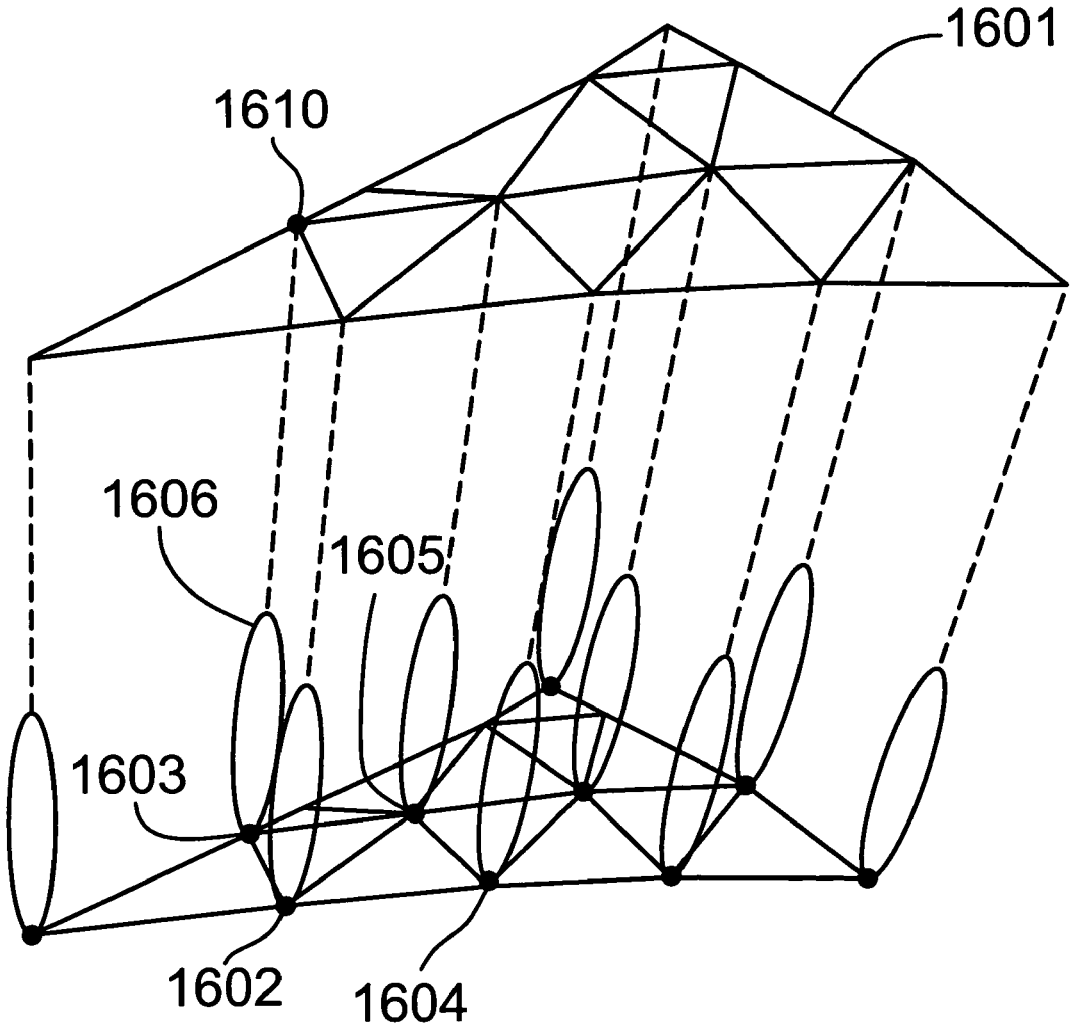
FIG. 16 illustrates a schematic diagram of assembling toroidal segments in three-dimensional form.
Figure 17:
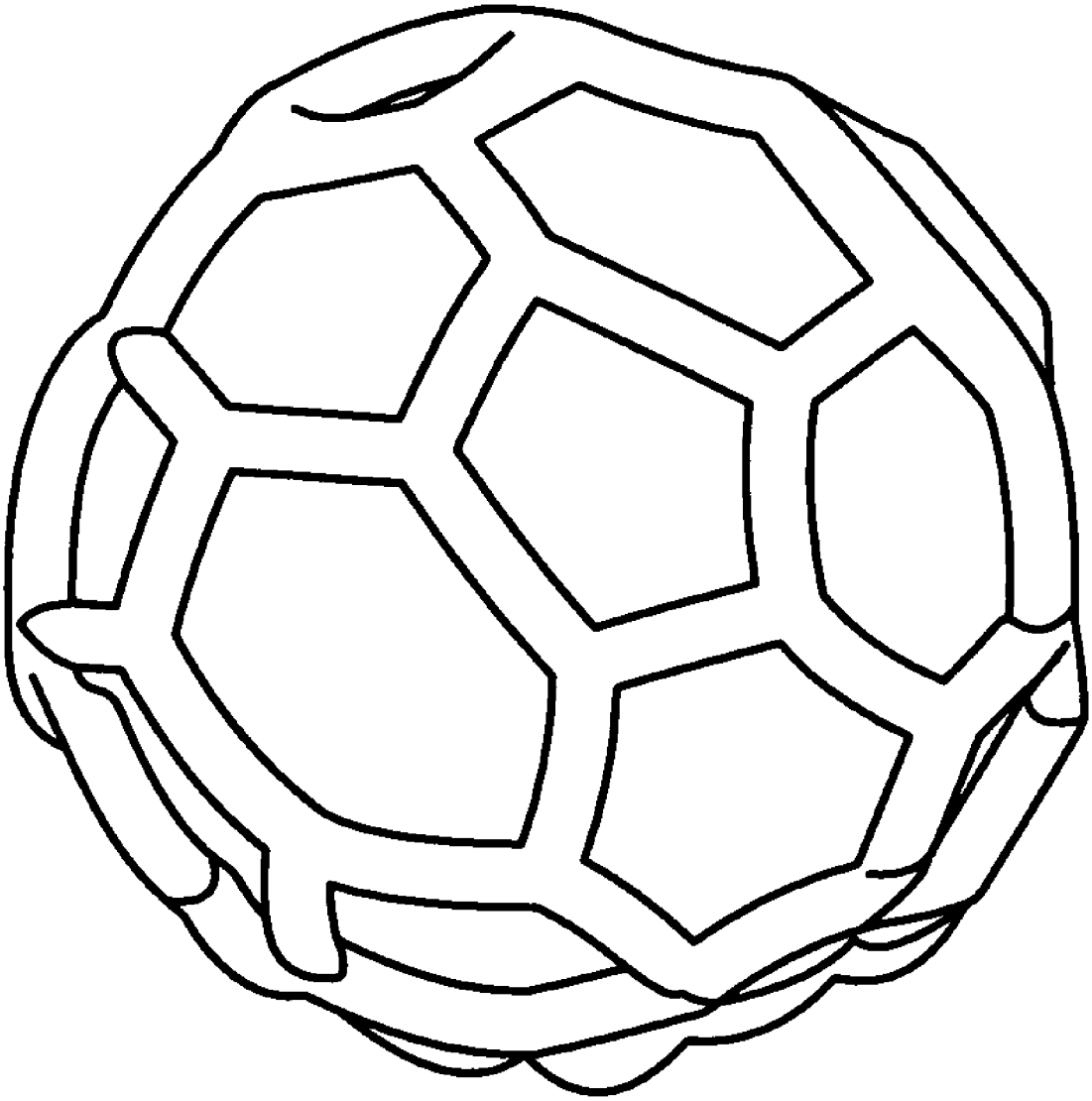
FIG. 17 provides an illustrating of a toroidal cloth having hexagonal and pentagonal segments formed over and around an object.

These different properties allow the toroidal cloth to take on a multitude of types of shapes: planer, tubular, contoured planer, or 3-dimensional for example as illustrated in for example, FIGS. 15-17.

Due to the nature of construction of the toroidal cloth, described below, stress, and tension (pressure) on the cloth is evenly distributed and dissipated. Further, the toroidal cloth as described herein is advantageous as it is relatively easy to assemble and preferably does not use any additional parts for assembly and can be customized to form-fit.

The toroidal cloths described herein may be constructed using a number of toroids having different sizes, shapes and/or materials. For example, different sizes of toroids may be combined to create a contoured and/or form fitting fabric that conforms to a person's body shape. It is noted that a form fitting characteristic may be achieved for example by using toroids that contain at least some type of stretchable material such as elastic. In this embodiment, the toroids are assembled into a cloth and since the cloth is preferably elastic it can stretch around various forms. Further, a contoured characteristic may be created using different sized toroids along with creating toroidal knots in a variety of positions along the circumference of the toroids. This will create a cloth that is no longer flat but gives the cloth a shape that leaves the plane of what typically might be a flat cloth.

Accordingly, as illustrated for example in FIGS. 2A-3C, 6A-6B, and 8-13 there is provided a toroidal cloth comprising a plurality of closed-loop toroids (e.g. 100, 102) interconnected together, each toroid having a body 12 defining an interior or center 18. The toroidal cloth comprises: a first toroid 100 of the plurality of toroids having a first proximal portion 106 and a first distal portion 105; a second toroid 102 of the plurality of toroids having a second proximal portion 104 and a second distal portion 103. An interconnection (e.g. a knot 112) between the first 100 and the second toroid 102 formed by looping the first proximal portion 106 around the body of the second toroid 102 and passing through the interior 18 of the first toroid 100 adjacent to the first distal portion 105 to cause the first distal portion 105 to be positioned adjacent to the body of the second toroid 102, thereby creating a knot (e.g. 112).

The following description provides examples of interconnecting two toroids of a plurality of toroids together. It will be understood that the following knots are not limiting and other knots connecting at least one toroid to at least one other toroid may be envisaged. Further it will be understood that the knots described below may be used to tie together more than one toroid to more than one other toroid. According to one embodiment (for example illustrated in FIG. 12), the toroidal cloth may include a combination of knots (e.g. combination of the standard toroidal knot for interconnecting some of the toroids and a non-slip knot for interconnecting the remaining toroids) described herein.

Exemplary Toroidal Cloth Using One or More Standard Toroidal Knots

Figure 6A:
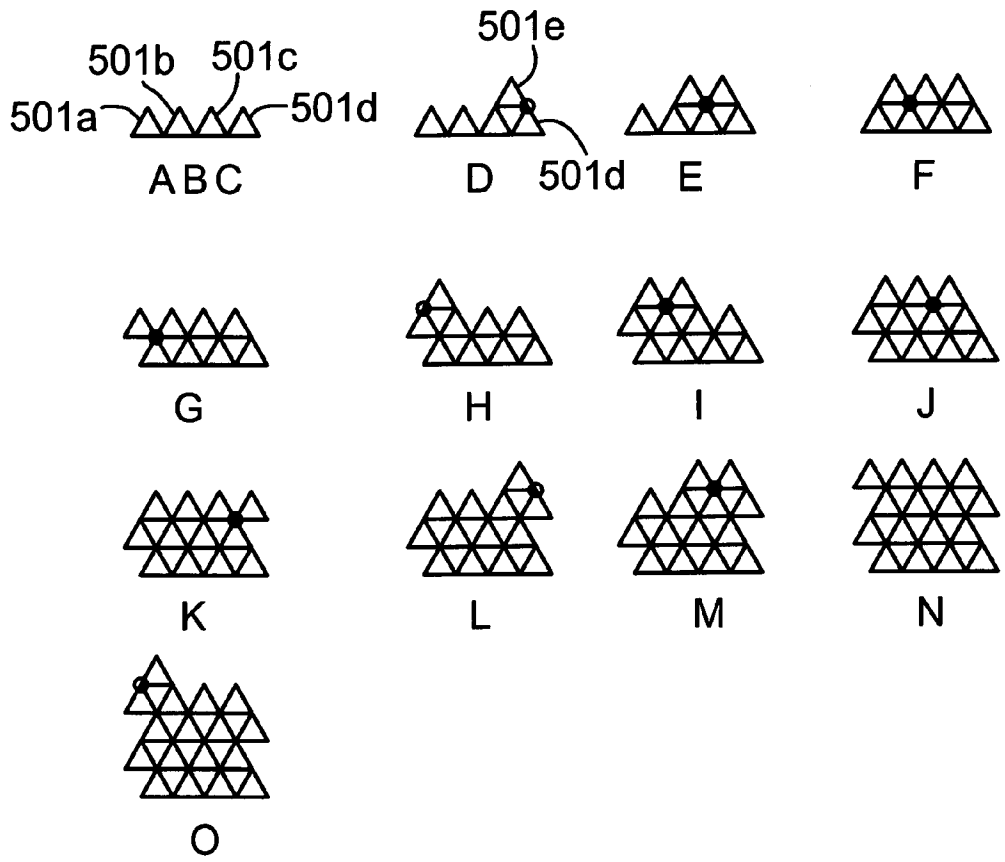
FIG. 6A illustrates a schematic diagram of assembling toroidal segments in a straight panel form.

Each toroid or multiple toroids in a toroidal cloth are connected to one or more other toroids. In the embodiment illustrated in FIG. 6A, shown is a toroidal cloth made using a straight panel technique. Each toroid (e.g. 501*a*-501*d*) is attached to an adjacent toroid using the standard toroidal knot described above. That is, toroid 501*a* is first attached to toroid 501*b* via a first standard toroidal knot; toroid 501*c* is then attached to toroid 501*b* via a second standard toroidal knot. The process is repeated as needed to expand the cloth horizontally to a desired length. In order to expand the cloth vertically, additional rows are added to the toroidal cloth by knotting an upper toroid (e.g. toroid 501*e*) to a toroid in a lower row (e.g. toroid 501*d*). The process can then be repeated in the second row to obtain the desired length, at each stage adding and additional knot between two adjacent toroids.

Figure 6B:
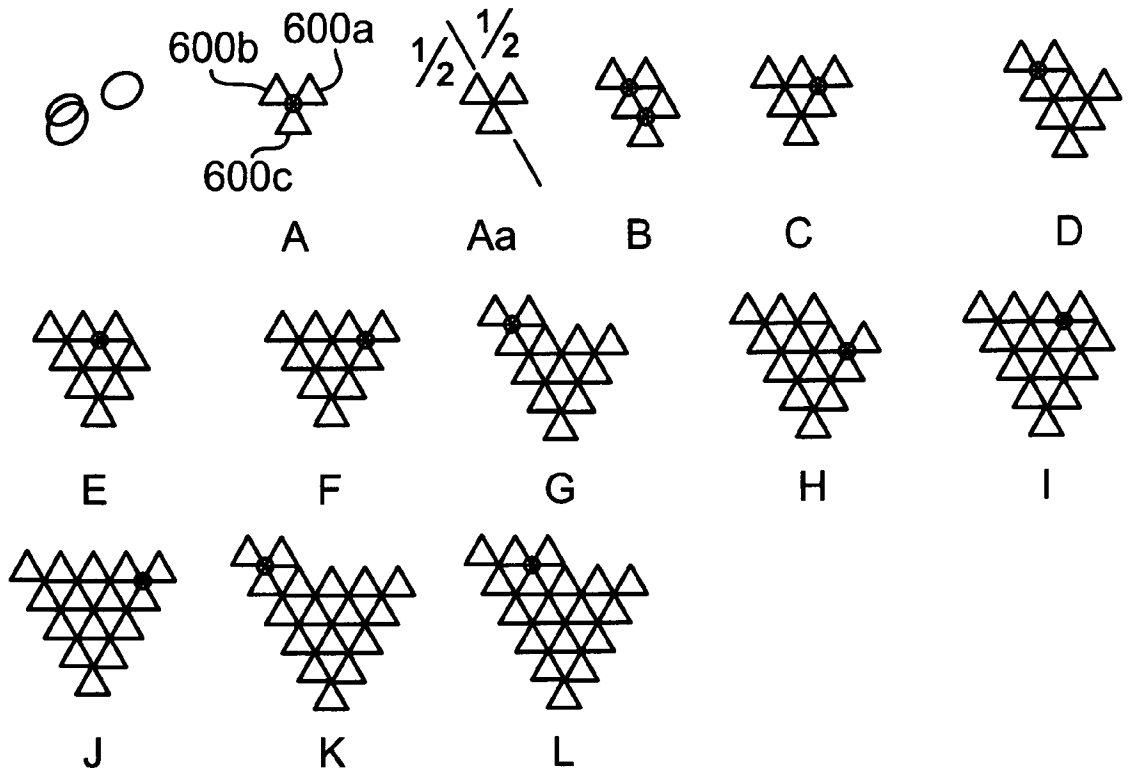
FIG. 6B illustrates a schematic diagram of assembling toroidal segments in a triangular panel form.

Referring to FIG. 6B, shown is the illustration of creating a toroidal cloth having a triangular panel. The triangular panel sequence is an expansion of the straight panel illustrated in FIG. 6A, except that the sequence starts with a single toroid in the triangular panel sequence (e.g. first row has a single toroid 600*c*) where the straight panel has a plurality of toroids (e.g. 501*a*-501*d*) in the first row). In the triangular sequence, as illustrated in FIG. 6B, two toroids (e.g. 600*a*, 600*b*) are tied to a single toroid (e.g. 600*c*) in a row directly adjacent to the two toroids.

Figure 7:
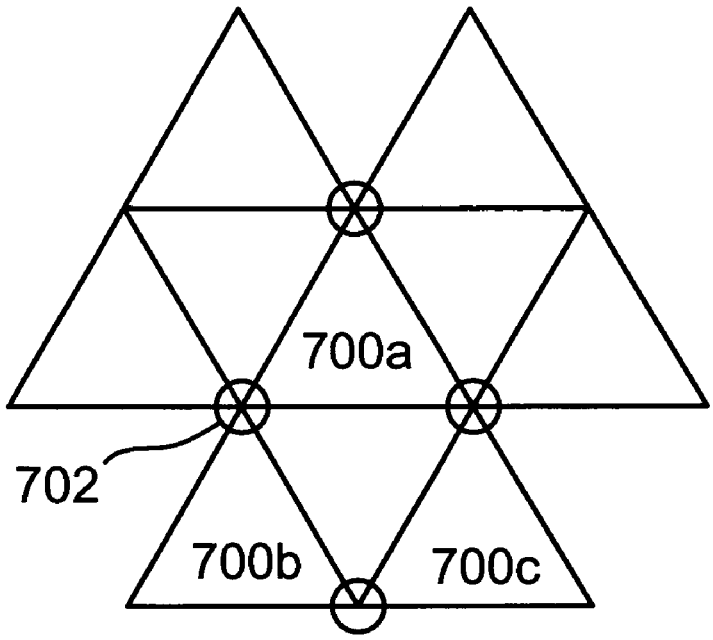
FIGS. 7-10 illustrate the steps for creating a triangular panel cloth using a standard toroidal knot.

In the embodiment described herein, and shown in FIG. 6B-7, each toroid (e.g. toroids 700*a*) is attached using standard toroidal knots 702 described above to a maximum of three other toroids 700*b*, 700*c* at points substantially equidistant apart along the first toroid's 700*a* circumference.

In the depicted embodiment of the standard-knot toroidal cloth, the cloth is created by first attaching three toroids together via a standard toroidal knot in the following way. Using the standard knot described above, but instead of one upper toroid, attach two upper toroids to a lower toroid. That is, two toroids are placed on top of each other with the centers aligned to have one shared aperture defined therethrough. A third toroid is used to make a knot through the first and second toroids as described above in relation to the standard toroidal knot. That is, once the two toroids are aligned on top of one another, the proximal portion or the distal portion of a third toroid is passed through the center of the first two toroids and the proximal portion of the third toroid then folds over the first two toroids through its own center and pulled through to create a knot as described earlier.

Figure 8:
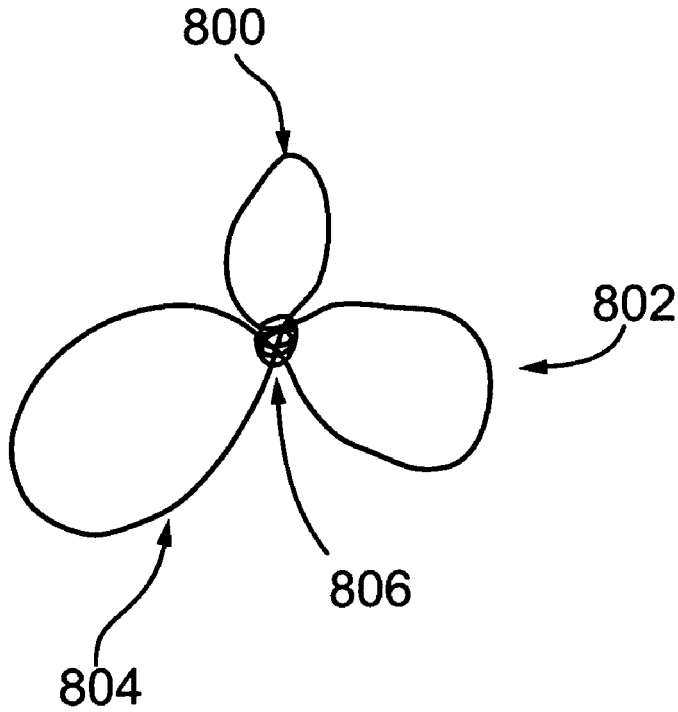

Referring to FIG. 8 shown is the resulting creation, which has three toroids 800, 802, 804 attached at one point, 806 by a standard toroidal knot. For simplicity, the three attached toroids will be referred to as the cloth.

Figure 9:
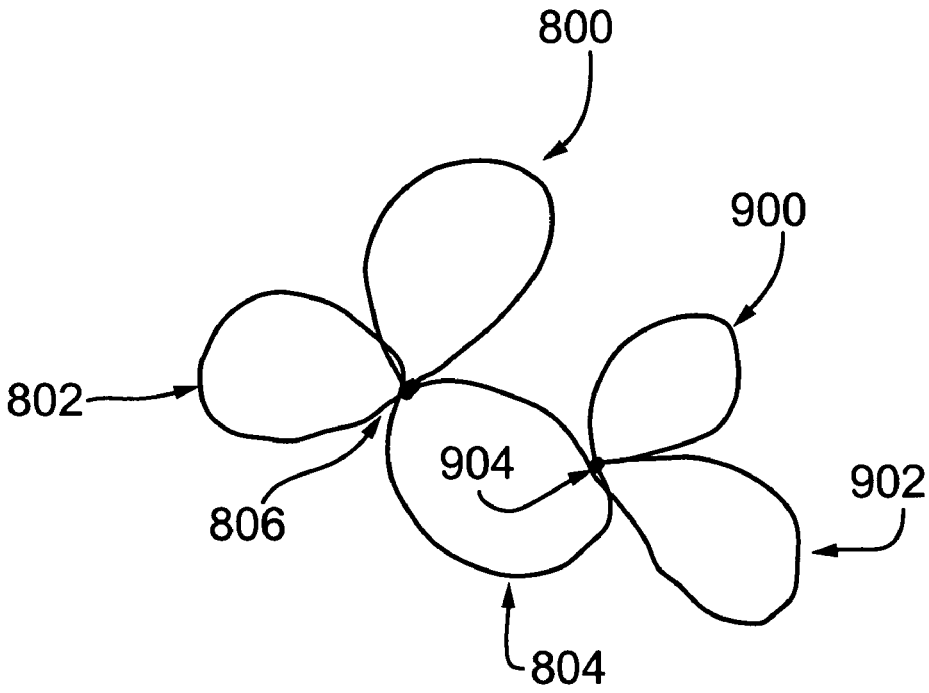

FIG. 9 shows the next step in creating a standard knot toroidal cloth. Two more toroids 900, 902 are tied together at a point 904 on one of the toroids 804 in the cloth. This point will be one third of the length of the circumference from the existing knot 806 on the toroid 804. This new standard knot is formed at the point 904 in the manner described above. Two toroids 900, 902 are used together in the same way as the single lower toroid (e.g. 800) was in the above description. The two toroids 900, 902 are aligned together on top of each other and folded in identical, mimicking ways. This results in a simple knot between the two new toroids 900,902 and the remaining cloth. As illustrated in FIG. 9, the resulting cloth now has five toroids attached.

Figure 10:
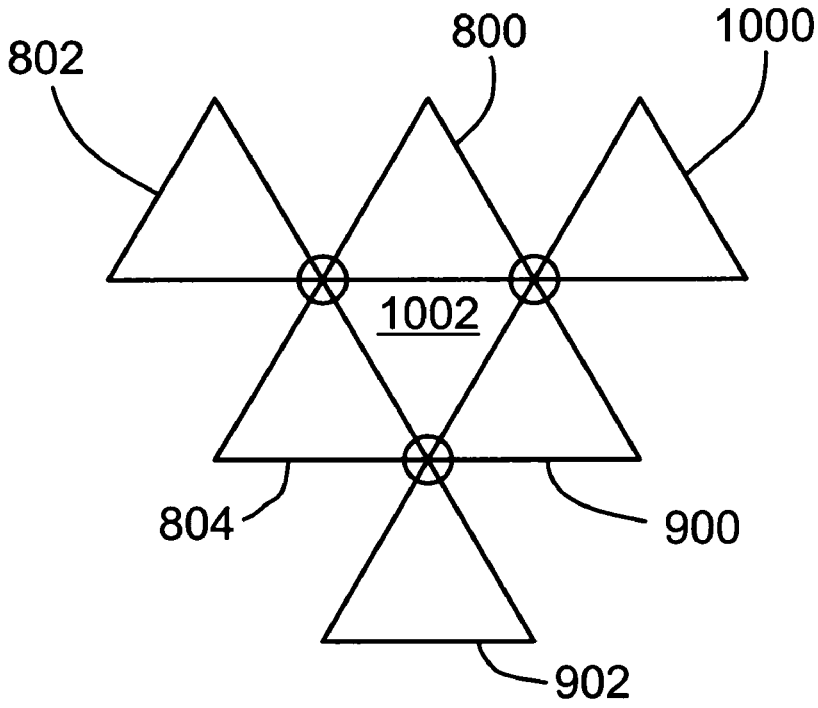

Referring to FIG. 10, a new toroid 1000 attaches to two existing toroids 800 and 900 from the cloth by using a standard toroidal knot as described above. This creates a triangulation 1002 involving parts of three toroids 800, 804, and 900 attached together by simple knots.

This pattern can be repeated by adding additional toroids to form neighbouring and multiple triangulations, as shown in FIG. 7. As will be understood by a person skilled in the art, the triangular panel formed of toroids provides a uniform and efficient distribution of tension in the resulting cloth. Further the triangular panel formed partially or exclusively of toroids minimizes running or tearing. As illustrated in FIG. 6B, each toroidal component is typically connected to two other toroidal components. This ensures that with any failure of an individual toroidal component (e.g. 600*c*), the unravelling is limited to only the toroidal components (e.g. 600*a*, 600*b*) in contact with the toroidal component which failed (e.g. 600*c*).

Figure 14:
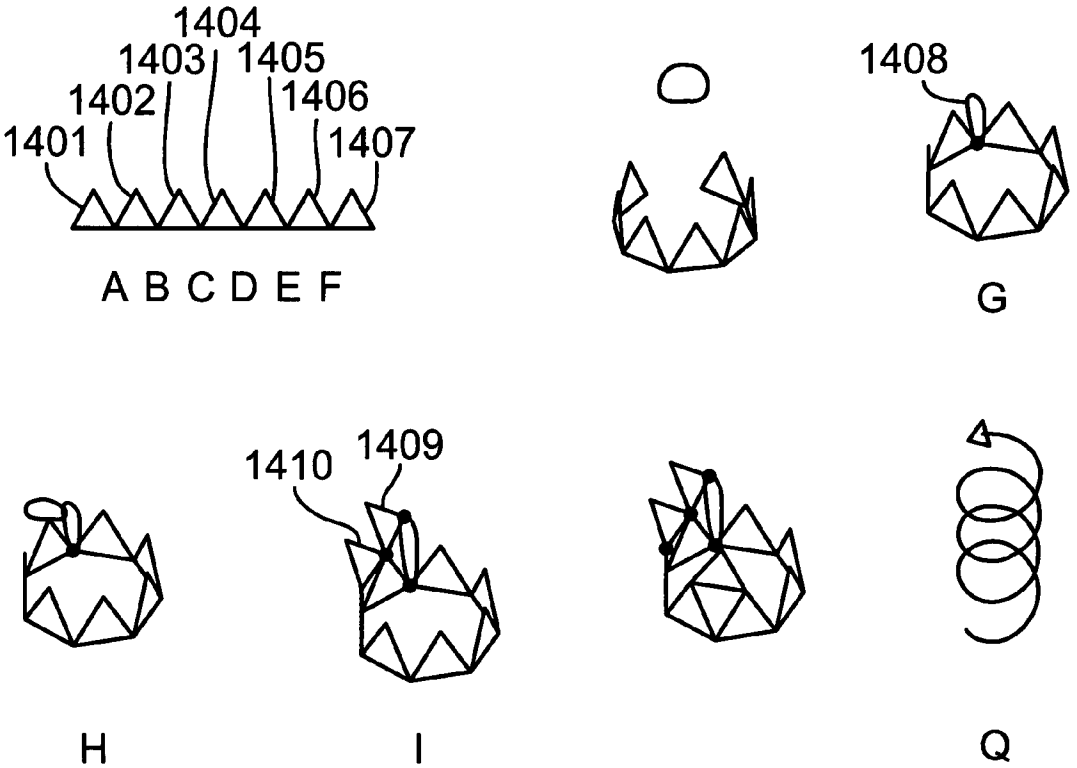
FIG. 14 illustrates a schematic diagram of assembling toroidal segments in circular form.

Referring to FIG. 14, shown is a toroidal cloth made using the circular panel technique. As can be seen, the circular panel technique is similar to that of the straight panel technique illustrated in FIG. 6A. The difference is that at the end of each row (e.g. first row shown as toroids 1401-1407) a toroid (e.g. toroid 1408) is used to tie the first and the last toroid (e.g. toroid 1401 and 1407) in the row directly adjacent to it. In this way a closed loop is formed of the row (e.g. toroids 1401-1407) and a subsequent row of toroids (e.g. 1409-1410) can be attached to the row below (e.g. toroids 1401-1407) using the same knotting technique as that described relating to the straight panel technique.

Exemplary Toroidal Cloth Using Non-Slip Knots

Figure 11:
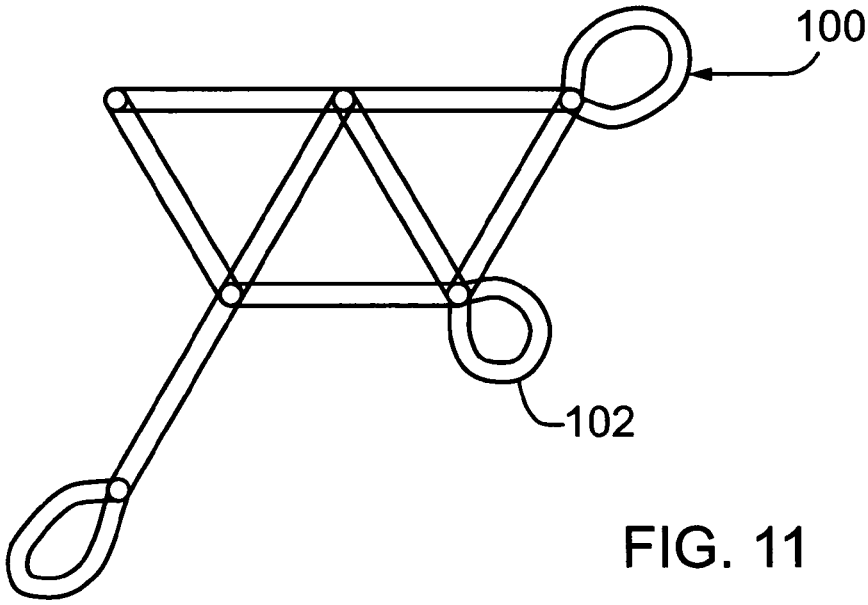
FIGS. 11-13 illustrate the steps for creating a toroidal cloth using a combination of a different knots.
Figure 12:
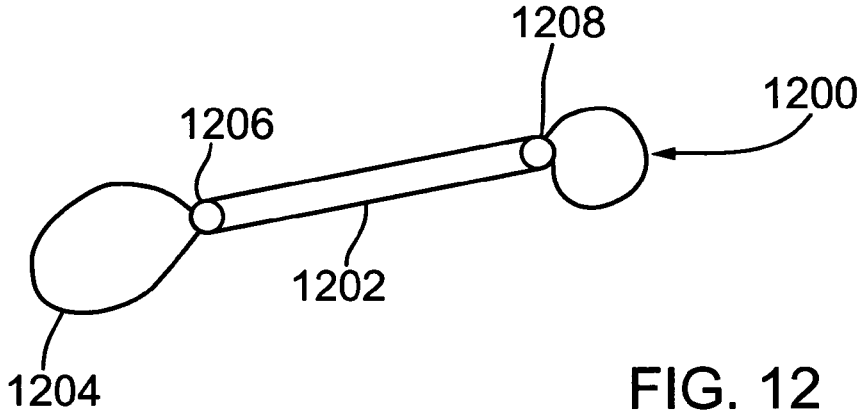
Figure 13:
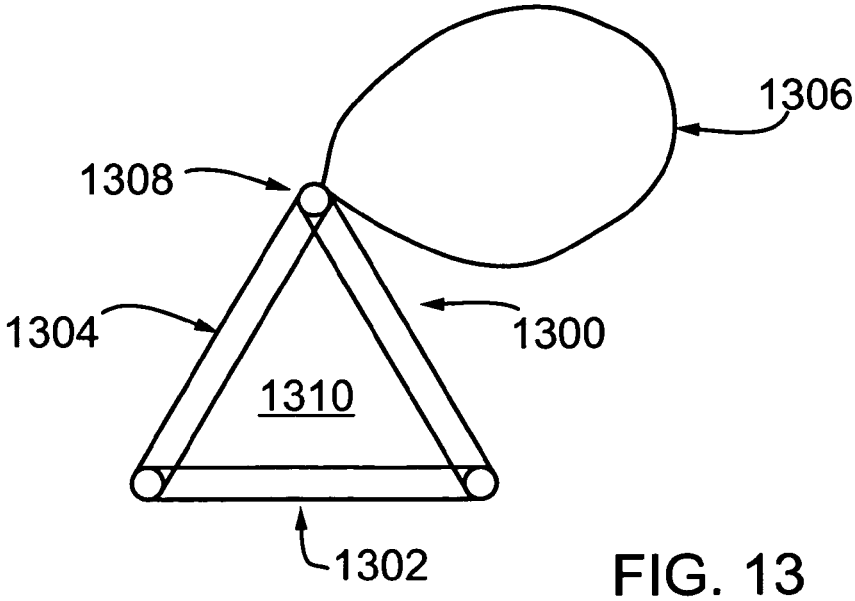

FIGS. 11-13 show one embodiment of a cloth created by non-slip knots as described earlier. The first step in the process for creating a non-slip knot toroidal cloth is shown in FIG. 12. Three toroids 1200, 1202, 1204 are attached in sequence via non-slip knots 1206 and 1208 using the non-slip knot process described above. As will be understood a number of additional toroids may be added linearly to this sequence using non-slip knots. Further, it may be envisaged that a combination of non-slip knots and standard toroidal knots are used. For example, referring to FIG. 12, toroid 1200 may be knotted with an adjacent new toroid (not shown) using the standard toroidal knot described above.

FIG. 13 shows a subsequent step for the non-slip knot toroidal cloth. In this case, two toroids 1300, 1304 are attached at the end segments of each toroid to the same third toroid 1302. In order to complete the triangular aperture 1310, the two toroids 1300, 1304 are each knotted a new adjacent toroid 1306 using the non-slip knot in the following way. The end segments of the two toroids 1300, 1304 are substantially overlapped with each other and manipulated as described above in relation to FIG. 8. That is, the two toroids 1300, 1308 are overlapped and a proximal portion of the third toroid 1306 is passed through the combined center of the toroids 1300, 1308. The proximal end of toroid 1306 is subsequently pulled toward its distal end and through the center of toroid 1306 in order to complete the knot.

Following this pattern additional toroids can be attached to the cloth via non-slip knots to create additional triangulation structures, thereby forming the toroidal cloth.

An example implementation of FIGS. 11-13 can be seen in FIG. 17 where a plurality of toroids are connected using for example, non-slip knots and standard toroidal knots over an object having a predefined shape (e.g. a ball) to form for example, a spherical assembly. It will be understood that other shapes may be envisaged using the same technique on a different object. In the embodiment illustrated in FIG. 17, the plurality of toroids have been used to create a hexagonal and pentagonal shapes. It will be understood that the process described in FIGS. 11-13 may be used to generate any type of polygon.

According to the embodiments described herein, an industrial cloth can be made of a unique structure derived from the sequential knotting of toroidal components, used partially or exclusively. As described herein, different knotting techniques can produce planar, contoured planar, circular, and/or three-dimensional cloth. As illustrated, for example, in FIGS. 6A-6B, except for the last toroid assembled in the sequence, each toroid ties one or more other toroids and is tied or knotted by one or more other toroids. Any material in the form of a toroid can be utilized in the embodiments described herein, such as fiber, composite materials or other materials suitable for cloths. Other materials for forming the toroids include circularly knitted textile, wire (metal or plastic) that is knitted or wound in a circular (e.g. closed-loop toroidal) fashion, elastic bands, metal rings, wood materials, and other materials such as metal, plastic, leather, vinyl, rubber which may be punched or cast in the form of a toroid.

Preferably, as described earlier at least some of the toroids within a toroidal cloth are made of materials which possess at least some resilience and/or pliability such as to allow them to be stretched and knotted according to the embodiments described herein. As described earlier, non-pliable toroids may be used within the toroidal cloth provided that the adjacent toroids to the non-pliable toroids are pliable. In this way the pliable toroids may be manipulated to create the knots herein with the non-pliable adjacent toroids.

Contoured Toroidal Cloth

Referring to FIG. 15, shown is an example of a toroidal cloth having a contoured shape. In this case, a contoured shape refers to a toroidal cloth that follows the shape of an object (e.g. a As illustrated in FIG. 15, a similar technique to the straight panel (e.g. illustrated in FIG. 6A) as described above may be used (e.g. rows 1500, row 1510 and 1520 are interconnected in a similar manner). However, contrary to the straight panel technique described above, in order to obtain a contoured shape, at least some of the toroids forming the toroidal cloth (e.g. toroid 1501-1503) have different circumferences as compared to one another and the knots/interconnections (e.g. 1505-1506) are formed at predefined positions (e.g. not necessarily equidistant positions along the length of a toroid) in order to obtain the desired contoured shape.

Three-dimensional Toroidal Cloth

Referring to FIG. 16, shown is an example of a toroidal cloth having a three-dimensional shape. In this case, the three-dimensional shape is formed first by forming a planar assembly of interconnected toroids 1601 (e.g. using the straight panel or triangular panel sequences described above) interconnected using a series of primary knots (e.g. knots interconnecting adjacent toroids within one layer such as knot 1610). Subsequently, a plurality of secondary knots (e.g. knots interconnecting connecting between different layers 1602-1605) are formed on top of at least some of the existing primary knots by a plurality of toroids (e.g. 1606) located transversely to the plane defined by the planar assembly 1601. In this way, instead of a single toroid being tied to two other toroids (as provided by the primary knot 1610) the secondary knot ties two toroids to two other toroids. In a similar manner, once another plane (or layer) of toroids is desired for the three-dimensional shape, a knot connecting two toroids to three other toroids is used to receive the toroid from a previous layer. It will be understood, that the secondary knots 1602-1605 may be incorporated with the first layer 1601 while forming the first layer 1601. In this way, additional layers may be added using the interconnecting or secondary knots to achieve a desired thickness.

It will be evident to those skilled in the art that the invention can take many forms, and that such forms are within the scope of the invention as claimed. Therefore, the spirit and scope of the appended claims should not be limited to the description of the preferred versions contained herein.

I claim:

1. A method of forming a toroidal structure comprising a plurality of closed-loop toroids interconnected together, each toroid having a body defining an interior, the method comprising:

providing a first toroid of the plurality of toroids having a first proximal portion and a first distal portion;

providing a second toroid of the plurality of toroids having a second proximal portion and a second distal portion;

forming an interconnection between the first and the second toroid by looping the first proximal portion around the body of the second toroid and passing through the interior of the first toroid adjacent to the first distal portion to cause the first distal portion to be positioned adjacent to the second proximal portion wherein each toroid includes an intermediate portion defined between the proximal and the distal portion and forming the interconnection comprises looping the first proximal portion around the intermediate portion of the second toroid to cause the first distal portion to be positioned adjacent to the second toroid's intermediate portion; and forming a second interconnection by passing the first proximal portion through an interior of the second toroid defined by the second proximal portion and the intermediate portion to cause the first distal portion to be positioned adjacent to the second proximal portion.

2. A method according to claim 1, wherein forming the interconnection comprises looping the first proximal portion around the second proximal portion and passing the first proximal portion through the interior of the first toroid.

3. A method according to claim 1 wherein the interconnection and each subsequent interconnection between the first toroid and other adjacent toroids of the plurality of closed-loop toroids is formed equi-spaced along the circumference of the first toroid to provide a triangulated structure.

4. A method according to claim 1 wherein each toroid of the plurality of toroids has the same circumference.

5. A method according to claim 1 wherein at least some of the toroids of the plurality of toroids have different circumferences.

6. A method according to claim 5 further comprising forming each interconnection of the plurality of toroids at predefined points along the circumference of each toroid, the predefined points in dependence upon a desired shape of the toroidal structure.

7. A method according to claim 1 wherein the interconnection is formed respectively between each two adjacent toroids forming an intraconnected row of the plurality of toroids.

8. A method according to claim 7 further comprising interconnecting adjacent rows of said intraconnected rows via a closing interconnection formed between a toroid of an adjacent row, a toroid at the proximal end of the intraconnected row and a toroid at the distal end of the intraconnected row.

9. A method according to claim 1 further comprising (a) providing a third toroid having a third proximal portion and a third distal portion;

(b) forming a third interconnection between the first, second and third toroids by overlapping the first and second toroids, looping the third proximal portion around the body of the first and the second toroids and passing the third proximal portion through the interior of the third toroid adjacent to the third distal portion to cause the third distal portion to be positioned adjacent to the first and the second proximal portions.

10. A method according to claim 1 wherein at least one of the first toroid and the second toroid is sufficiently pliable to facilitate forming the interconnection.

11. A method according to claim 1 further comprising (a) providing a third toroid having a third proximal portion and a third distal portion;

(b) providing a fourth toroid having a fourth proximal portion and a fourth distal portion;

(c) forming the interconnection between the first, second, third and fourth toroids by overlapping the first and second toroids to form a first set of toroids as well as independently overlapping the third and the fourth toroids to form a second set of toroids, looping the proximal portion of the second set of toroids around the body of the first set of toroids and passing the proximal portion of the second set of toroids through the interior of the second set of toroids adjacent to the second set's distal portion to cause the second set's distal portion to be positioned adjacent to the first set's proximal portion;

wherein one of the first, second, third and fourth toroids is operable to be manipulated to form subsequent interconnections with other toroids in a layer adjacent to the other ones of the first, second, third and fourth toroids.

* * * * *